US005392602A

United States Patent [19]

Matsumoto

[11] Patent Number: 5,392,602

[45] Date of Patent: Feb. 28, 1995

[54] EXHAUST EMISSION CONTROL DEVICE FOR MOTOR BICYCLE

[75] Inventor: Akio Matsumoto, Hamamatsu, Japan

[73] Assignee: Suzuki Kabushiki Kaisha, Japan

[21] Appl. No.: 116,280

[22] Filed: Sep. 3, 1993

[30] Foreign Application Priority Data

May 28, 1993 [JP] Japan ..... 5-127260

[51] Int. Cl.[6] ..... F01N 3/20

[52] U.S. Cl. ..... 60/299; 60/312; 60/314; 181/227

[58] Field of Search ..... 60/299, 312, 314, 322, 60/324; 181/227, 228

[56] References Cited

U.S. PATENT DOCUMENTS

| | | | |
|---|---|---|---|
| 3,462,947 | 8/1969 | Nowak | 60/314 |
| 3,665,712 | 5/1972 | Tenney | 60/314 |
| 3,841,841 | 10/1974 | Torosian | 60/299 |
| 3,842,599 | 10/1974 | Ehlen | 60/312 |
| 3,853,484 | 12/1974 | Sudar | 60/299 |
| 4,094,645 | 6/1978 | Bailey | 60/299 |
| 4,809,800 | 3/1989 | Suzuki | 60/312 |
| 5,012,642 | 5/1991 | Laimbock | 60/299 |
| 5,043,147 | 8/1991 | Knight | 60/299 |
| 5,218,817 | 6/1993 | Urata | 60/299 |

*Primary Examiner*—Ira S. Lazarus
*Assistant Examiner*—Daniel J. O'Connor
*Attorney, Agent, or Firm*—Bruce L. Adams; Van C. Wilks

[57] ABSTRACT

An improved exhaust emission control device is disposed in a motor bicycle of the type in which a muffler body, containing a catalyst for exhaust emission control, is connected to an exhaust pipe extending from the exhaust port of the associated engine, and the exhaust pipe is inserted into the muffler body through the front section thereof and extends through the inner space of the muffler body to the rear section thereof. The exhaust pipe is turned back in U-shape at the rear section to the front section of the inner space of the muffler body and the catalyst, supported by a partition wall which is disposed in the muffler body, is positioned in the vicinity of the opening of the exhaust pipe.

15 Claims, 6 Drawing Sheets

EXHAUST EMISSION CONTROL DEVICE FOR MOTOR BICYCLE

BACKGROUND OF THE INVENTION

The present invention relates to an exhaust emission control device for a motor bicycle.

FIG. 5 is a longitudinal sectional view of an exhaust emission control device 100 for use in a motor bicycle and, in particular, a scooter-type motor bicycle. In the exhaust emission control device 100, an exhaust pipe 101 extending from the exhaust port of the associated engine is connected to a muffler body 102.

The inner space of the muffler body 102 is divided into three expansion chambers 105*a*, 105*b* and 105*c* by partitions 103 and 104. The exhaust pipe 101 is inserted through the front section of the muffler body 102 to open into the expansion chamber 105*a*.

A catalyst 106 is provided in the partition 103 in such a way as to penetrate therethrough, and a connection pipe 107 passes through the partition 104. A discharge pipe 108 for allowing the expansion chamber 105*c* to communicate with the exterior of the muffler body 102 is provided at the rearmost end of the muffler body 102.

In this exhaust emission control device 100, exhaust gas from the exhaust pipe 101 enters the expansion chamber 105*a* and passes through the catalyst 106 to flow into the expansion chamber 105*b*. Then, it flows through the connection pipe 107 to enter the expansion chamber 105*c*, from which it is discharged to the exterior through the discharge pipe 108. In this process, the harmful components of the exhaust gas, such as hydrocarbon HC and carbon monoxide CO, are removed therefrom by the catalyst 106 and, at the same time, the exhaust gas expands inside the expansion chambers 105*a*, 105*b* and 105*c* to effect a muffling function.

In this exhaust emission control device 100, however, the exhaust pipe 101 opens into the foremost section of the muffler body 102, that is, the exhaust pipe 101 is not sufficiently long. As a result, the engine output characteristics may deteriorate. In particular, the torque during low-speed running tends to be rather weak.

In view of this, an exhaust emission control device 110 as shown in FIG. 6 has been developed. Like the above-described exhaust emission control device 100, this exhaust emission control device 110 is divided into three expansion chambers 114*a*, 114*b* and 114*c* by partitions 112 and 113. An exhaust pipe 115, which is inserted through the front end of a muffler body 111, extends through the partition 112 to open into the rear section of the expansion chamber 114*b*.

A catalyst 116 is provided in the partition 113 in such a way as to penetrate therethrough. A connection pipe 117 for connecting the expansion chambers 114*a* and 114*c* to each other extends through the partitions 112 and 113. Further, a discharge pipe 118 for allowing the expansion chamber 114*a* to communicate with the exterior of the muffler body 111 extends through the partitions 112 and 113 and the rearmost section of the muffler body 111.

In this exhaust emission control device 110, the exhaust gas which flows through the exhaust pipe 115 first enters the intermediate expansion chamber 114*b* and then passes through the catalyst 116 to enter the rear expansion chamber 114*c*. Then, it flows through the connection pipe 117 to enter the front expansion chamber 114*a* before it is finally discharged to the exterior of the muffler body 111 through the discharge pipe 118.

In the thus constructed exhaust emission control device 110, the length of the portion of the exhaust pipe 115 inside the muffler body 111 is increased, so that a sufficient overall exhaust-pipe length is secured, thereby improving the engine output characteristics.

However, in the above-described structure, the catalyst 116, whose temperature is raised as a result of its reaction with the exhaust gas, is located in the rearmost section of the muffler body 111, with the result that the rear section of the muffler body 111 becomes hot. Since the rear section of the muffler body 111 generally protrudes beyond the periphery of the motor bicycle, it is liable to come into contact with human bodies and other object and cause harm thereto. Thus, to prevent such harm, it is necessary to provide a shielding plate around the muffler body 111, resulting in an increase in the production cost of the motor bicycle.

SUMMARY OF THE INVENTION

An object of the present invention is to substantially eliminate defects or drawbacks encountered in the prior art and to provide an exhaust emission control device in which a sufficient length of the exhaust pipe is secured inside the muffler body to improve the engine performance and in which the likelihood of harm caused by the hot rearmost section of the muffler body can be prevented.

This and other objects can be achieved according to the present invention by providing an exhaust emission control device for a motor bicycle in which a muffler body, having an inner space and containing a catalyst means for exhaust emission control, is connected to an exhaust pipe extending from an exhaust port of an associated engine, wherein the exhaust pipe is inserted into the muffler body from a front section thereof and extends through the inner space of the muffler body to a rear section thereof, at which the exhaust pipe is turned in U-shape to extend back to the front section of the inner space of the muffler body, the catalyst means being positioned in the vicinity of an opening of the U-turned front end of the exhaust pipe.

In a preferred embodiment, the exhaust pipe is provided with a bent portion at an intermediate portion thereof, and the catalyst means is disposed inside the muffler body in a manner offset along a width dimension of the motor bicycle. The inner space of the muffler body is formed as an expansion chamber which is divided into front, intermediate and rear sections with respect to a flow of an exhaust by front and rear partition walls and the catalyst means is supported by the front partition wall. The front and rear sections of the expansion chamber are communicated with each other through a connection pipe which is supported by the front and rear partition walls.

An inner wall structure is disposed to an inner peripheral portion of the muffler body so as to provide a double wall structure and the inner wall structure is formed by a punching plate carrying a catalyst component.

In another aspect of the present invention, there is provided an exhaust emission control device for a motor bicycle in which a muffler body is connected to an exhaust pipe extending from an exhaust port of an associated engine unit, the exhaust emission control device comprising:

an exhaust pipe inserted into an inner space of the muffler body and extending therethrough from a front portion of the muffler body with respect to a flow of an exhaust to a rear portion thereof;

a plurality of partition walls disposed inside the inner space of the muffler body so as to divide the inner space into a plurality of sections; and a catalyst means disposed inside the inner space of the muffler body and supported by one of the partition walls, wherein a front end of the exhaust pipe is turned at the rear portion of the muffler body to extend back to the front portion thereof so as to provide a U-shape and the catalyst means is positioned in the vicinity of an opening of the U-turned front end of the exhaust pipe.

According to the exhaust emission control device for a motor bicycle, constructed as described above, the exhaust pipe is formed to make a U-turn in the rear section of the inner space of the muffler body, so that the exhaust pipe can be made sufficiently long, thereby improving the engine performance. Further, the exhaust pipe, after turning back in a U-shape, extends to the front section of the inner space of the muffler body, and the catalyst is provided in the vicinity of the opening of this exhaust pipe. Since the catalyst, which attains a high temperature, is arranged in the front section of the muffler body, the rear section of the muffler body, which protrudes beyond the body of the motor bicycle, does not become hot. Thus, if the rear section comes into contact with human bodies, etc., no harm will be caused.

Further, due to the bent section provided in the middle of the exhaust pipe, a longer portion of the exhaust pipe can be installed inside the muffler body, thereby further contributing to an improvement of the engine performance.

In addition, since the catalyst inside the muffler body is inwardly offset along the width dimension of the motor bicycle, the heat generated by the catalyst is mainly conducted to the inner side of the muffler body, so that the temperature of the outer side of the muffler body is relatively low, thereby even more effectively preventing the above-described harm which would be caused by the heat generated by the catalyst.

Further features and advantages of the present invention will be made more clear hereunder through descriptions made with reference to the accompanying drawings.

DESCRIPTION OF THE PREFERRED EMBODIMENT

An embodiment of the present invention will be described hereunder with reference to the drawings.

Figure 1:
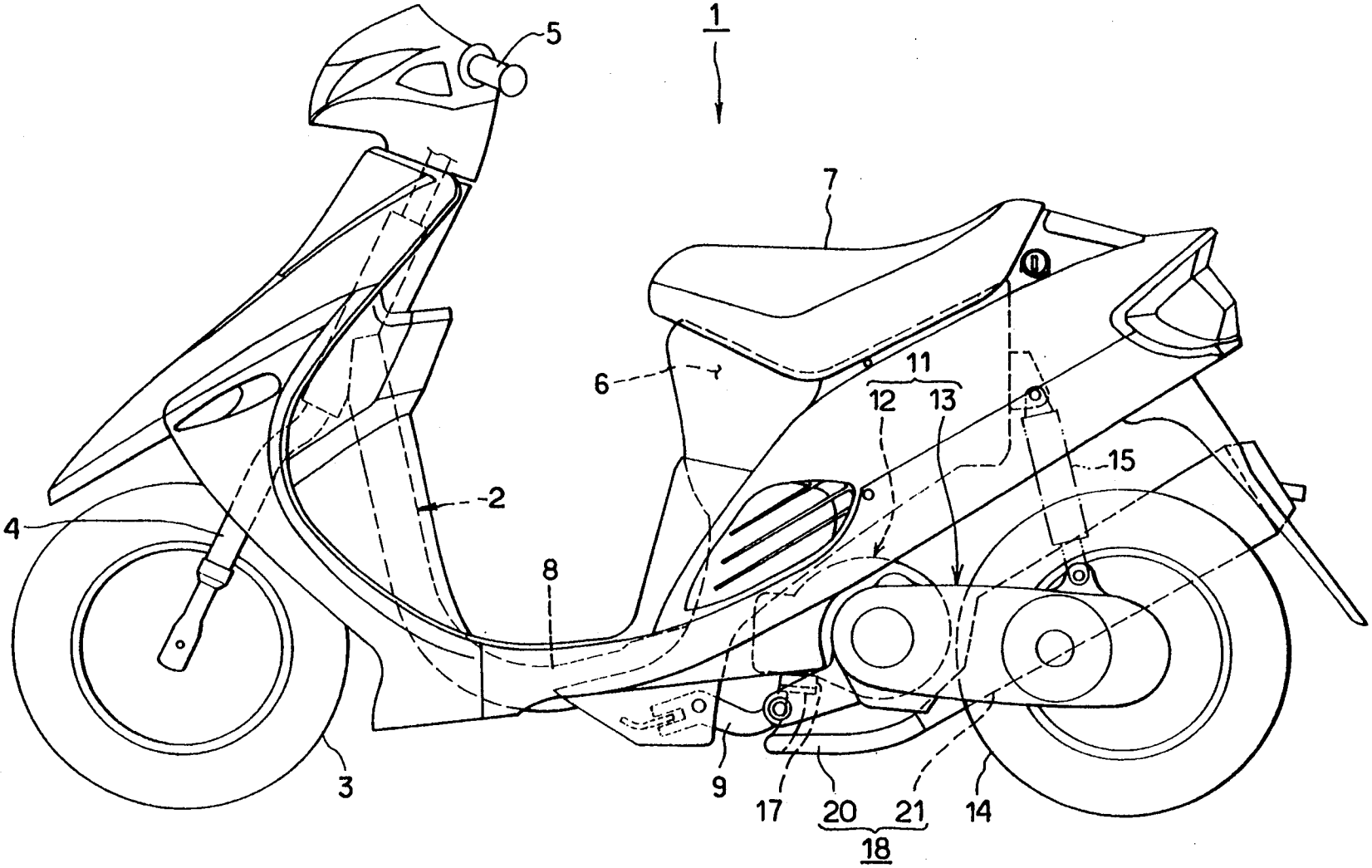
FIG. 1 is a left-hand side view of a scooter-type motor bicycle to which the exhaust emission control device of the present invention is applied.
Figure 2:
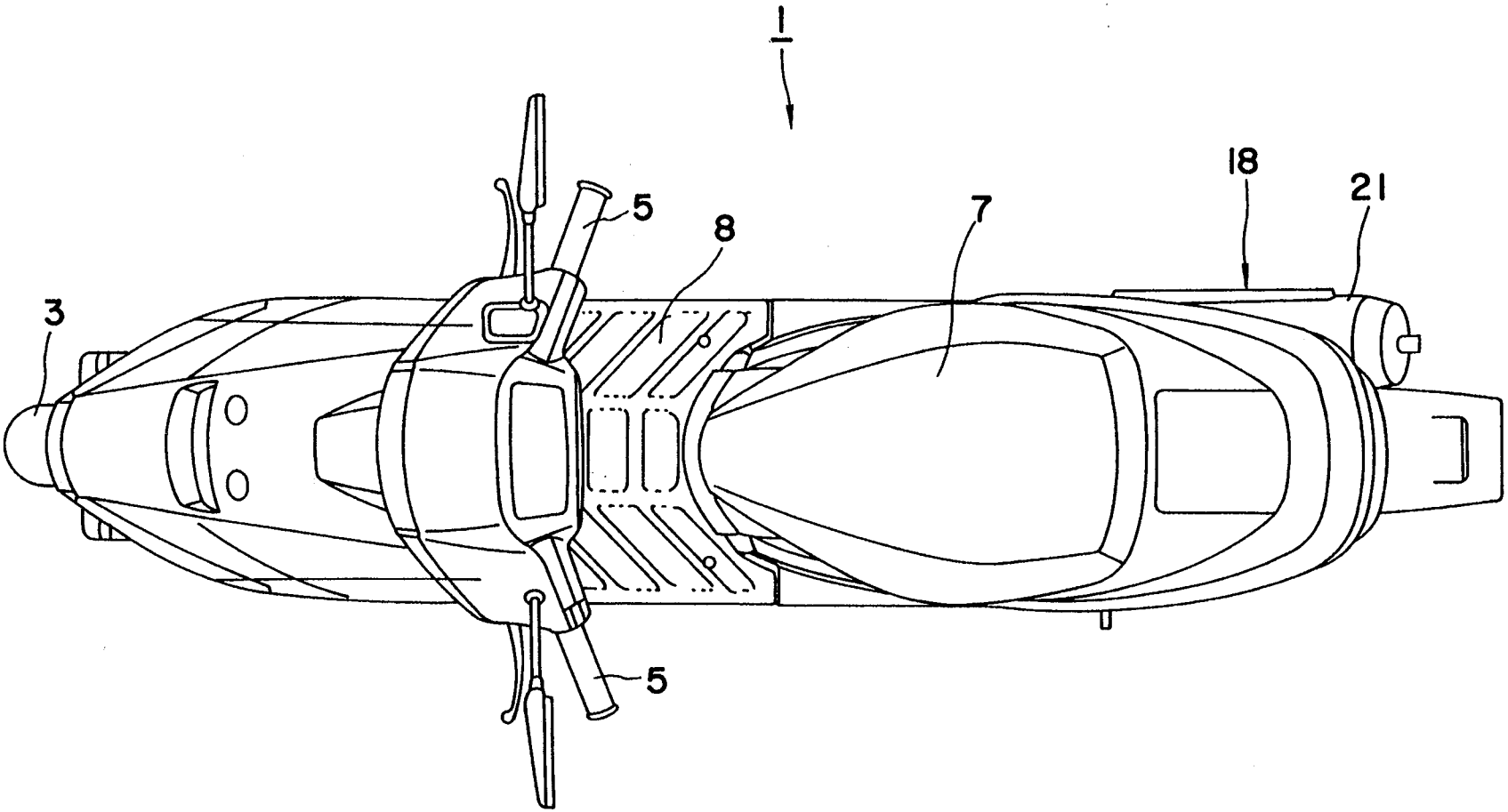
FIG. 2 is a plan view of the motor bicycle shown in FIG. 1.

FIG. 1 is a left-hand side view of a scooter-type motor bicycle to which the exhaust emission control device of the present invention is applied. FIG. 2 is a plan view of this motor bicycle.

Referring to FIGS. 1 and 2, this motor bicycle, indicated by numeral 1, has an under-bone-type vehicle frame 2, to the front head section of which a front fork 4 for supporting a front wheel 3 is mounted together with a handle bar 5 in such a way as to be pivotable to the right and left.

A compartment 6 for containing a helmet, etc. is formed in the rear inner section of the vehicle frame 2. A seat 7 which can be opened and closed is provided on top of the compartment 6. A large curved space is defined between the seat 7 and the handle bar 5, and a step board 8 for the rider to put his feet is formed at the bottom of this space.

A power unit 11 is joined to the lower rear section of the step board 8 through the intermediation of a link 9 in such a way as to be vertically swingable. The power unit 11 consists of an engine 12 and a power transmission case 13, which are formed into an integral unit. A rear wheel 14 is rotatably supported by the rear section of the power transmission case 13, the power of the engine 12 being transmitted to the wheel 14 through a power transmission device, not shown, contained in the power transmission case 13. A shock absorber 15 is connected between the rear section of the power unit 11 and the rear section of the vehicle-body frame 2.

An exhaust emission control device 18 is connected to an exhaust port 17 of the engine 12. In the exhaust emission control device 18, a muffler body 21 is connected to an exhaust pipe 20 extending rearward from the exhaust pipe 17, and a catalyst 22 for exhaust emission control is provided inside the muffler body 21 (see FIGS. 3 and 4). The exhaust pipe 20 extends to the right-hand side of the rear wheel 14. The muffler body 21 extends obliquely rearwards to somewhat protrude beyond the periphery of the vehicle body, as shown in FIG. 2. The muffler body 21 is supported by a stay or the like extending from the engine 12.

Figure 3:
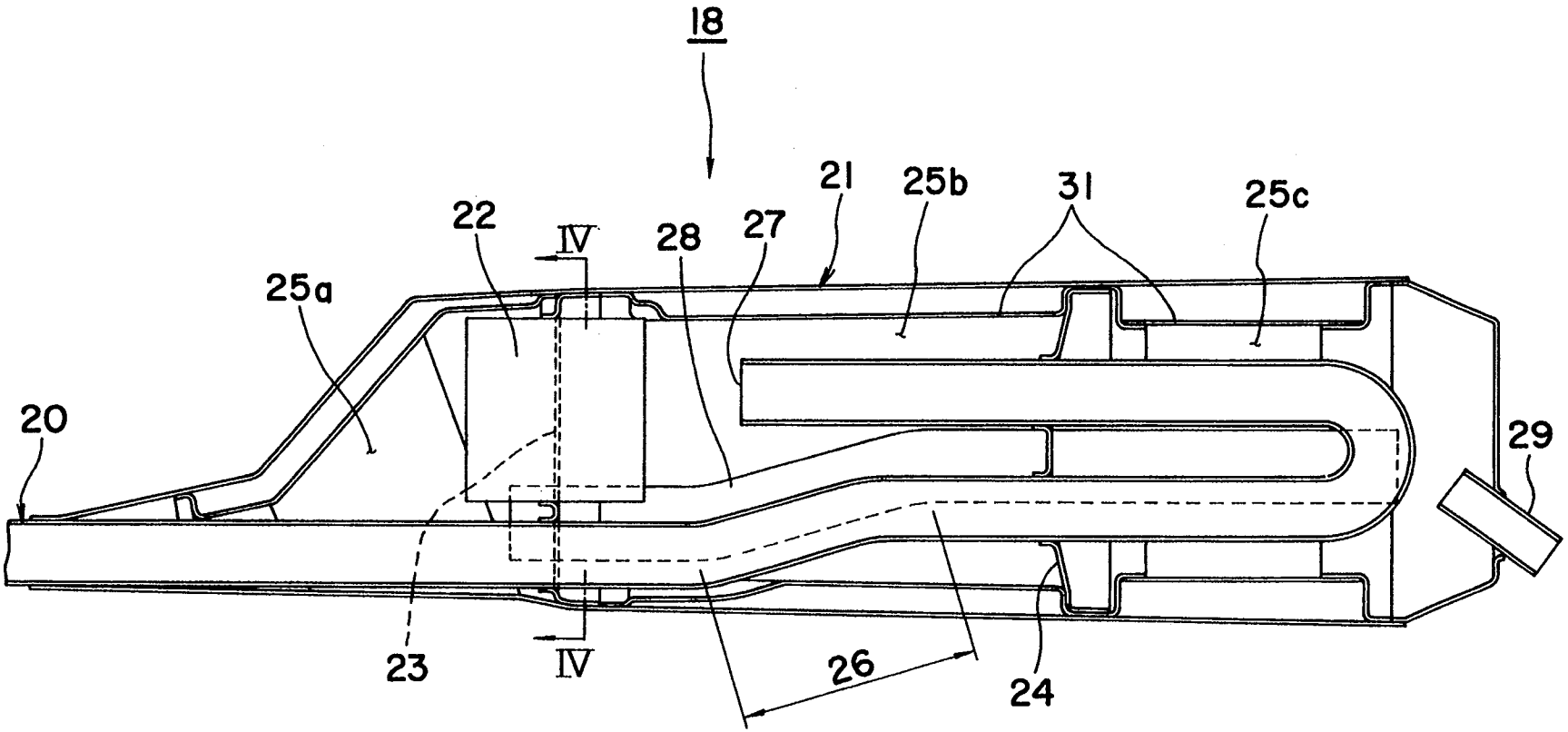
FIG. 3 is a longitudinal sectional view of an exhaust emission control device according to an embodiment of the present invention.
Figure 4:
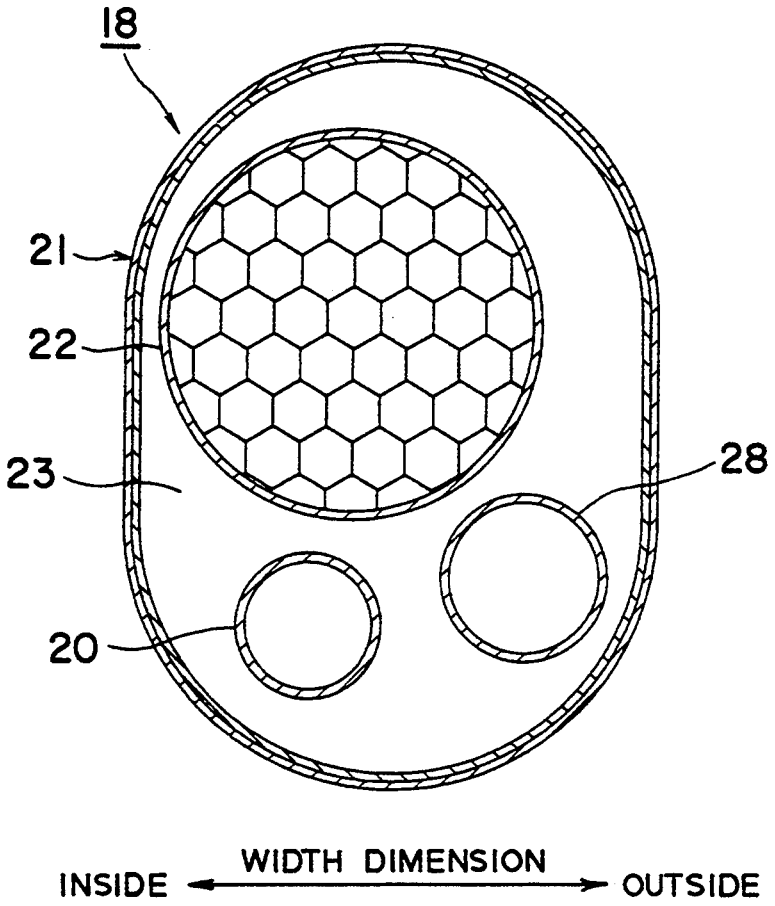
FIG. 4 is a sectional view taken along line IV—IV of FIG. 3.
Figure 5:
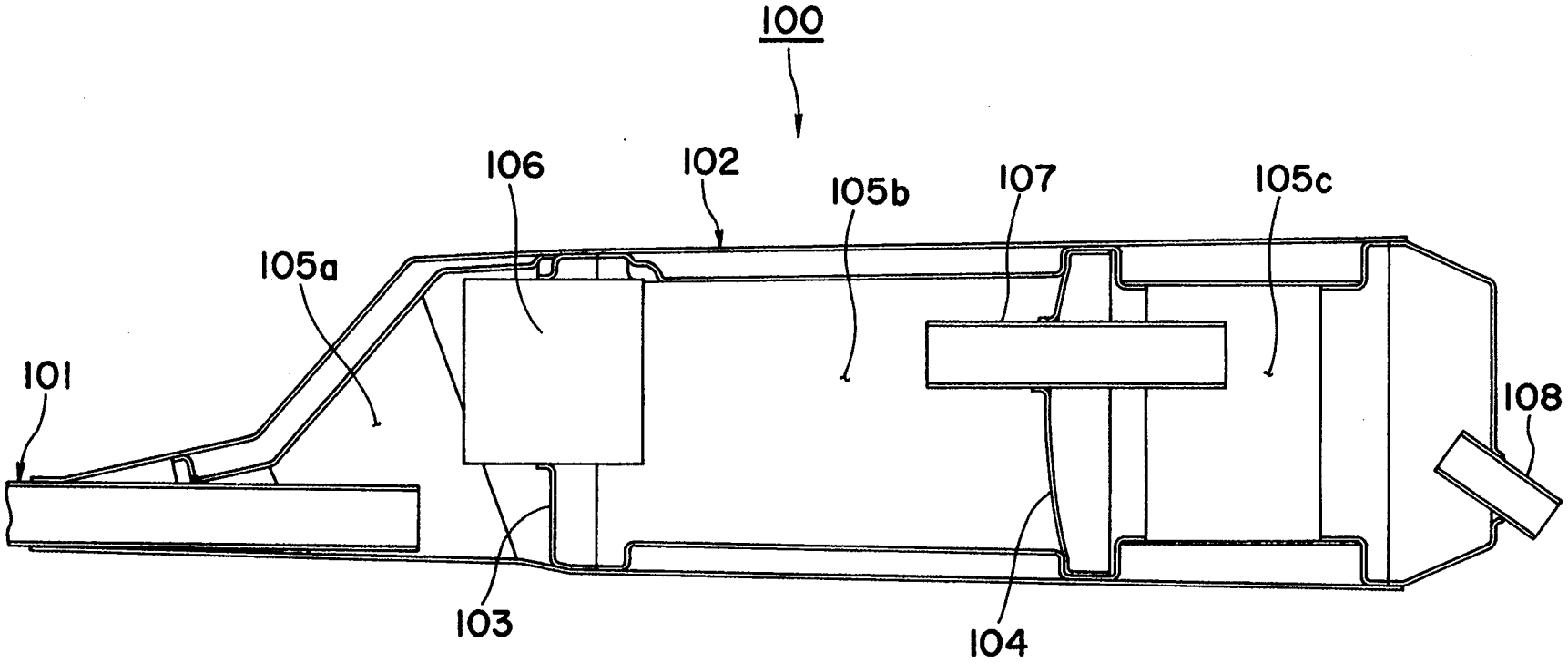
FIG. 5 PRIOR ART
FIG. 5 is a longitudinal sectional view showing a conventional exhaust emission control device.
Figure 6:
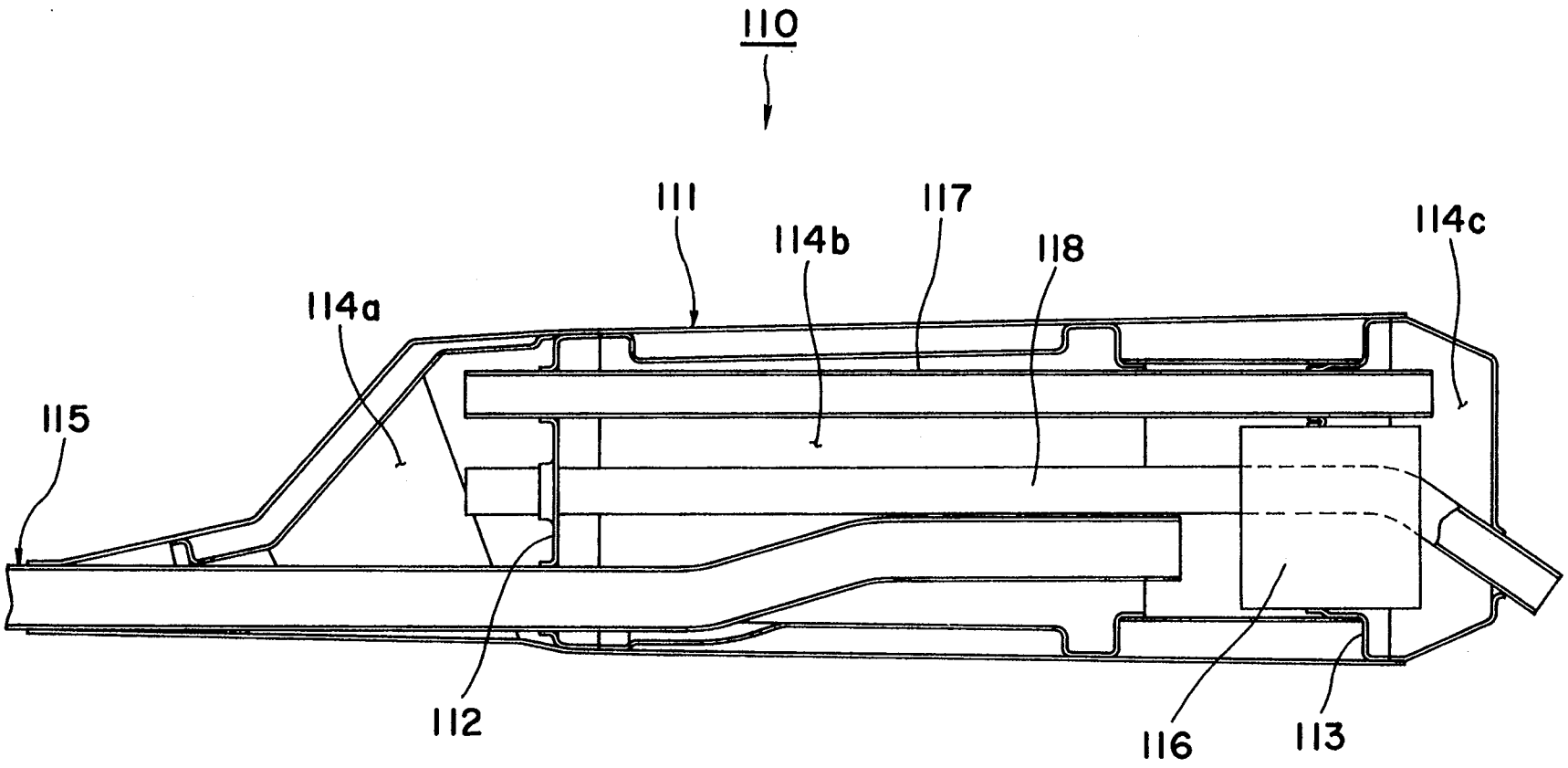
FIG. 6 PRIOR ART
FIG. 6 is a longitudinal sectional view showing another conventional exhaust emission control device.

FIG. 3 is a longitudinal sectional view of an exhaust emission control device according to an embodiment of the present invention and FIG. 4 is a sectional view taken along line IV—IV of FIG. 3. The inner space of the muffler body 21 is divided into three axially spaced expansion chambers or sections 25*a*, 25*b* and 25*c* by partitions 23 and 24.

The exhaust pipe 20 is inserted into the muffler body 21 through the front end thereof and extends through the partitions 23 and 24 to reach the rear section of the inner space of the muffler body 21. The exhaust pipe 20 is formed to make a U-turn within the rear portion of the muffler body 21, and extends back to the front section of the muffler body 21 to open into the front portion of the expansion chamber 25*b*. A bent section 26, which is bent, for example, into an S-shape, is provided in the middle of the exhaust pipe 20.

The catalyst 22 is provided in the partition 23 in such a way as to penetrate through it. The catalyst 22 has, for example, a honeycomb-like sectional configuration, to allow the expansion chambers 25*a* and 25*b* to communicate with each other and is made of, for example, a heat resisting material such as ceramics. The catalyst 22 is located in the vicinity of an outlet opening 27 of the exhaust pipe 20 and, at the same time, inwardly offset along the width dimension of the motor bicycle 1, as shown in FIG. 4.

The expansion chambers 25*a* and 25*c* communicate with each other through a connection pipe 28, which extends through the partitions 23 and 24. A discharge pipe 29 for allowing the expansion chamber to communicate with the exterior of the muffler body 21 is provided at the rearmost end of the muffler body 21.

A plurality of partitions, more than two, may be disposed in the inner space of the muffler body, and in such a structure, the catalyst will be supported to the partition located at the front side, with respect to the flow of the exhaust, and in such example, the connection pipe connects the most front side section and the most rear side section of the inner space as the expansion chamber of the muffler body.

A porous plate 31 consisting of a punching plate or the like and holding a catalyst material is provided in the inner periphery of the muffler body 21, thus forming the muffler body 21 so as to provide a double-wall tube structure.

The exhaust gas flowing through the exhaust pipe 20 makes a U-turn in the rearmost section of the muffler body 21, and enters the intermediate expansion chamber 25*b* through the opening 27 of the exhaust pipe 20. Then, the gas passes through the catalyst 22 to enter the front expansion chamber 25*a*. Further, it enters the rearmost expansion chamber 25*c* by way of the connection pipe 28 and is finally discharged to the exterior of the muffler body 21 through the discharge pipe 29.

In the above process, the harmful components of the exhaust gas, such as hydrocarbon HC and carbon monoxide CO, are removed by the catalyst 22 and the catalyst material held by the porous plate 31. At the same time, the exhaust gas expands within the expansion chambers 25*a*, 25*b* and 25*c*, thereby effecting a muffling function.

In the exhaust emission control device 18, constructed as described above, the exhaust pipe 20 is formed to make a U-turn inside the muffler body 2i, so that it is possible to secure a sufficient length of the exhaust pipe 20, thereby improving the performance of the engine 12.

Further, the exhaust pipe 20, formed to make a U-turn in the rear section of the muffler body 21, extends to the front section of the muffler body 21, and the catalyst 22 is provided in the vicinity of the opening 27 of the exhaust pipe 20. That is, the catalyst 22 is located in the front section of the muffler body 21. Therefore, when the catalyst 22 is heated to a high temperature as a result of its reaction with the exhaust gas, its heat is not readily conducted to the rear section of the muffler body 21. Thus, the rear section of the muffler body 21, protruding from the body of the motor bicycle 1, does not become hot, thereby preventing the harm which might otherwise be caused by the heat generated by the catalyst reaction.

Further, due to the bent section 26 provided in the middle of the exhaust pipe 20, it is possible to make the exhaust pipe 20 even longer, thereby further contributing to an improvement of the performance of the engine 12.

In addition, since the catalyst 22, provided inside the muffler body 21, is offset along the width dimension of the motor bicycle 1, the heat generated by the catalyst 22 is mainly conducted to the inner side of the muffler body, so that the temperature of the outer side of the muffler body 21 is relatively low, thereby even more effectively preventing the harm which would be caused by the heat generated by the catalyst.

The exhaust emission control device 18 is applicable not only to motor bicycles but also to other types of vehicles and engines.

As described above, in accordance with the present invention, there is provided an exhaust emission control device for motor bicycles of the type in which a muffler body, containing a catalyst for exhaust emission control, is connected to an exhaust pipe extending from the exhaust port of the associated engine, wherein the exhaust pipe is inserted into the muffler body through the front section thereof and extends through the inner space of the muffler body to the rear section thereof, where it makes a U-turn to extend back to the front section of the inner space of the muffler body, the above-mentioned catalyst being provided in the vicinity of the opening of the exhaust pipe.

Due to the above construction, a sufficient length of the exhaust pipe can be secured, thereby improving the performance of the associated engine. Further, since the catalyst, which attains a high temperature, is arranged in the front section of the muffler body, the rear section of the muffler body, which protrudes from the body of the motor bicycle, does not become hot, thereby preventing the harm which would be caused by the heat generated by the catalyst.

Further, the exhaust emission control device of the present invention is characterized by a bent section provided in the middle of the exhaust pipe. Due to this bent section, a longer portion of the exhaust pipe can be installed inside the muffler body, thereby further contributing to an improvement of the engine performance.

In addition, in the exhaust emission control device of the present invention, the catalyst inside the muffler body is offset along the width dimension of the motor bicycle. Therefore, the heat generated by the catalyst is mainly conducted to the inner side of the muffler body, so that the temperature of the outer side of the muffler body is relatively low, thereby even more effectively preventing the harm which would be caused by the heat generated by the catalyst.

It is to be noted that the present invention is not limited to the described embodiment and many other changes or modifications may be made without departing the scope of the appended claims.

What is claimed is:

1. An exhaust emission control device for a motor bicycle in which a muffler body, having an inner space and containing catalyst means for exhaust emission control, is connected to an exhaust pipe extending from an exhaust port of an engine, wherein the inner space of the muffler body is formed as an expansion chamber which is divided into at least front, intermediate and rear sections with respect to a flow of an exhaust by front and rear partition walls and said catalyst means is supported by the front partition wall, wherein said exhaust pipe is inserted into said muffler body from the front section thereof and extends through the inner space of the muffler body to the rear section thereof, at which the exhaust pipe is turned in U-shape so as to extend back to the front section of the inner space of the muffler body, said catalyst means being positioned in the vicinity of an opening of the U-turned front end of said exhaust pipe.

2. An exhaust emission control device according to claim 1, wherein said exhaust pipe is provided with a bent portion at an intermediate portion thereof.

3. An exhaust emission control device according to claim 1, wherein said catalyst means is disposed inside the muffler body in a manner offset along a width dimension of the motor bicycle.

4. An exhaust emission control device according to claim 1, wherein said exhaust pipe is supported by the front and rear partition walls.

5. An exhaust emission control device according to claim 1, wherein the front and rear sections of the expansion chamber are communicated with each other through a connection pipe which is supported by the front and rear partition walls.

6. An exhaust emission control device according to claim 1, wherein an inner wall structure is disposed to an inner peripheral portion of said muffler body so as to provide a double wall structure and the inner wall structure is formed by a punching plate carrying a catalyst component.

7. An exhaust emission control device for a motor bicycle in which a muffler body is connected to an exhaust pipe extending from an exhaust port of an engine unit, said exhaust emission control device comprising:

an exhaust pipe inserted into an inner space of the muffler body and extending therethrough from a front portion of the muffler body with respect to a flow of an exhaust to a rear portion thereof;

a plurality of partition walls disposed inside the inner space of the muffler body so as to divide the inner space into at least front, intermediate and rear sections; and catalyst means disposed inside the inner space of the muffler body and supported by one of the partition walls, wherein a front end of said exhaust pipe is turned at the rear section of the muffler body to extend back to the intermediate section thereof so as to provide a U-shape and said catalyst means is positioned in the vicinity of an opening of the U-turned front end of said exhaust pipe.

8. An exhaust emission control device according to claim 7, further comprises an inner wall structure disposed to an inner peripheral portion of said muffler body so as to provide a double wall structure, said inner wall structure being formed by a punching plate carrying a catalyst component.

9. An exhaust system for a motor bicycle having an engine which burns fuel and produces exhaust gases, the exhaust system comprising: a muffler having an expansion chamber divided by at least front and rear partition walls into at least front, intermediate and rear axially-spaced sections; an exhaust pipe extending serially through the front section into the intermediate section, through the intermediate section into the rear section, and around the rear section back into the intermediate section where the exhaust pipe terminates in an outlet opening for discharging exhaust gases into the intermediate section; catalyst means disposed in a flow path between the intermediate and front sections for reacting with the exhaust gases during the flow thereof from the intermediate section to the front section; and conduit means for flowing the exhaust gases from the front section to the rear section for discharge from the muffler.

10. An exhaust system according to claim 9; wherein the muffler has an inner side which faces inwardly toward the motor bicycle during use of the exhaust system and an outer side which faces outwardly away from the motor bicycle, the catalyst means being disposed inside the muffler at a position closer to the inner side than to the outer side to reduce heat transfer to the outer side.

11. An exhaust system according to claim 9; wherein the catalyst means is supported by the front partition and positioned in the vicinity of the outlet opening of the exhaust pipe.

12. An exhaust system according to claim 11; wherein the catalyst means is disposed directly in the path of exhaust gases discharged from the outlet opening.

13. An exhaust system according to claim 9; wherein the conduit means extends through and is supported by the first and second partition walls.

14. An exhaust system according to claim 9; wherein the catalyst means is disposed directly in the path of exhaust gases discharged from the outlet opening.

15. An exhaust system according to claim 9; wherein the exhaust pipe has a bent section located in the intermediate section of the expansion chamber.

* * * * *